United States Patent [19]

Fischer

[11] 3,996,909

[45] Dec. 14, 1976

[54] FUEL SHUT-OFF VALVE ASSEMBLY

[75] Inventor: Earl R. Fischer, Rochester, N.Y.

[73] Assignee: General Motors Corporation, Detroit, Mich.

[22] Filed: Feb. 21, 1975

[21] Appl. No.: 551,606

[52] U.S. Cl. ..... 123/124 B; 261/DIG. 19; 261/DIG. 74; 123/97 B; 123/198 DB

[51] Int. Cl.[2] ..... F02M 7/12

[58] Field of Search ..... 261/DIG. 19, DIG. 74; 123/124, 198 DB, 97 B, 124 B; 251/122

[56] References Cited

UNITED STATES PATENTS

| | | | |
|---|---|---|---|
| 2,155,670 | 4/1939 | Macbeth | 123/124 B |
| 2,886,020 | 5/1959 | Wolfe | 261/DIG. 19 |
| 2,895,561 | 7/1959 | McCollough | 180/82 |
| 3,042,387 | 7/1962 | King | 261/DIG. 19 |
| 3,414,244 | 12/1968 | Patterson | 251/122 X |
| 3,741,188 | 6/1973 | Rickey | 123/198 DB |
| 3,831,900 | 8/1974 | Matousek et al. | 251/122 |

*Primary Examiner*—Charles J. Myhre
*Assistant Examiner*—William C. Anderson
*Attorney, Agent, or Firm*—C. K. Veenstra

[57] ABSTRACT

In an internal combustion engine carburetor the idle mixture adjusting valve is supported in a guide member. A sleeve slides on the guide member and carries a closure portion engageable with a seat surrounding the idle fuel discharge port. A solenoid energized during deceleration moves the sleeve to engage the closure portion with the seat and interrupt fuel flow through the discharge orifice.

2 Claims, 4 Drawing Figures

FUEL SHUT-OFF VALVE ASSEMBLY

This invention relates to a fuel shut-off valve assembly which may be used in an internal combustion engine carburetor to interrupt flow through a fuel passage and, more particularly, to such a valve assembly which may interrupt fuel flow through the idle fuel discharge port during deceleration.

There have been numerous earlier proposals for mechanisms which shut off fuel flow to the idle fuel discharge port during deceleration. For example, in U.S. Pat. No. 2,895,561 a solenoid operated valve blocks the idle fuel passage some distance above the idle fuel discharge port; in carburetors of current design, however, it is frequently difficult to install such a valve in that location. In U.S. Pat. No. 2,886,020, the idle mixture adjustment valve is itself operated by a solenoid to shut off fuel flow through the idle fuel discharge port; however, that arrangement can only result in wear of the tapered metering portion of the adjustment valve and of the discharge port and thus in an increase in idle fuel flow.

This invention provides a fuel shut-off valve assembly which may be installed at the idle fuel discharge port and in which the valve and its associated seat are separate from the tapered metering portion of the adjustment valve and the discharge port.

The details as well as other features and advantages of this invention are set forth in the following detailed description and shown in the accompanying drawings wherein.

Figures 1, 2, 3, 4:
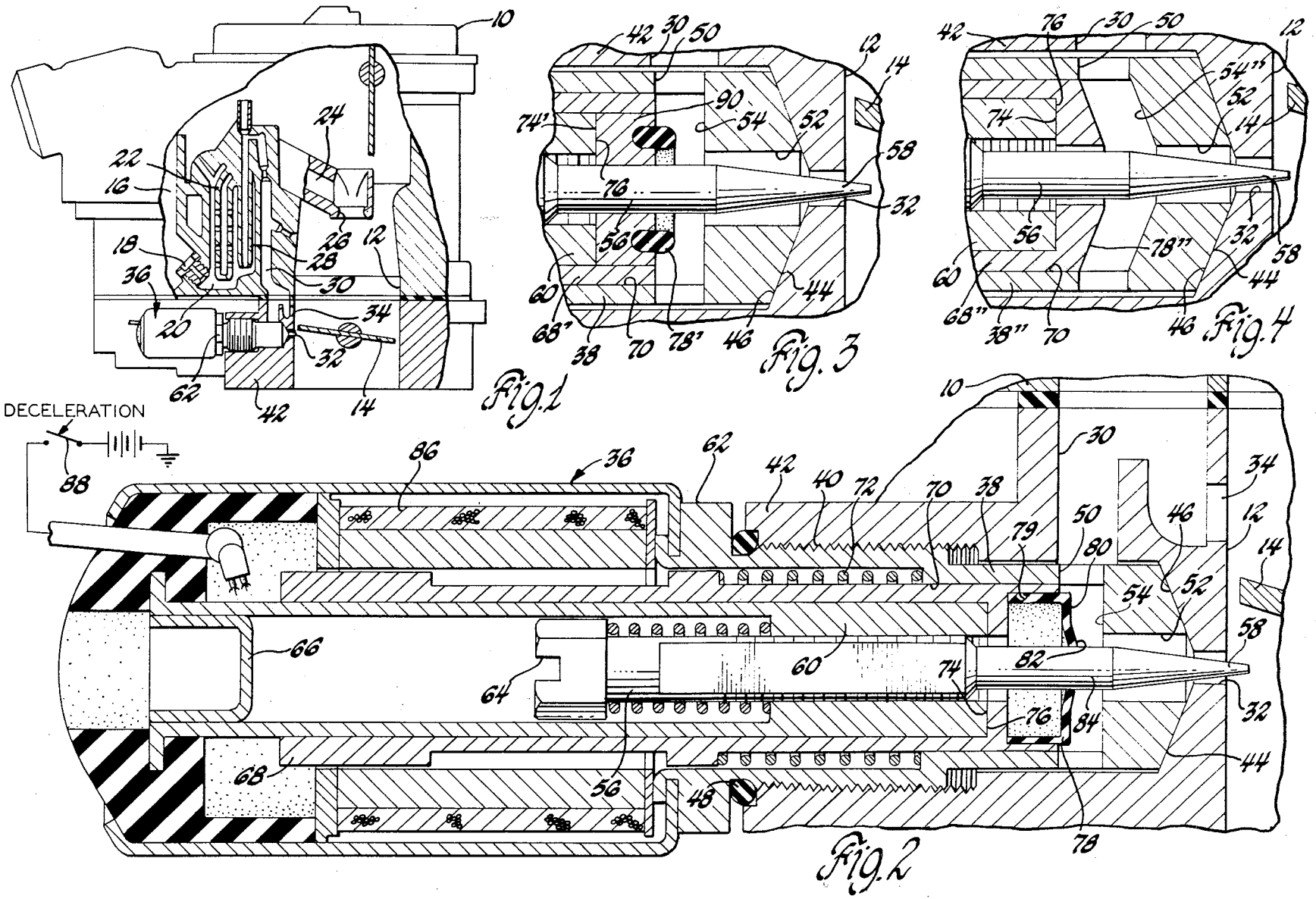
FIG. 1 is a side elevational view of a carburetor incorporating this shut-off valve assembly and in which parts of the carburetor have been broken away to schematically illustrate the idle fuel passage.
FIG. 2 is an enlarged sectional view of the shut-off valve assembly of FIG. 1 showing the details of its construction.
FIGS. 3 and 4 are views similar to a portion of FIG. 2 further enlarged to show alternative constructions for a closure sleeve.

Referring first to FIG. 1, a carburetor 10 has a mixture conduit 12 containing a throttle 14 controlling flow therethrough. A fuel bowl 16 supplies fuel through a main metering jet 18, a main well 20, and a main well tube 22 to a mixture passage 24 which discharges into a venturi 26 disposed in conduit 12.

An idle pick-up tube 28 receives fuel from main well 20 and discharges it through an idle fuel passage 30 which opens into mixture conduit 12 through an idle fuel discharge port 32 and an off-idle port 34.

A fuel shut-off valve assembly 36 is disposed in passage 30 to control flow through discharge port 32. As shown in FIG. 2, assembly 36 includes a body 38 having threads 40 for securing assembly 36 to the throttle body 42 of carburetor 10. Body 38 is beveled at its right-hand end 44 to engage a shoulder 46 formed in idle fuel passage 30, and an O-ring 48 seals against leaks through threads 40.

Body 38 is hollowed to form a portion of idle fuel passage 30 and includes an inlet port 50, an outlet 52, and an annular seat 54.

An idle mixture adjusting valve 56 has a tapered metering portion 58 disposed in discharge port 32. Valve 56 is threadedly supported in a guide member 60. In assembling valve assembly 36 to carburetor 10, a wrench is applied to a hex 62 on body 38 to secure body 38 to throttle body 42, a driver is inserted in slot 64 of valve 56 to turn valve 56 until a desired fuel flow is achieved through discharge port 32, and a plug 66 is inserted into guide member 60 to preclude tampering with the idle mixture setting.

A sleeve member 68 is slidably supported on guide member 60 within the bore 70 of body 38. A spring 72 biases sleeve member 68 leftwardly to engage a shoulder 74, formed on sleeve member 68, with the right-hand end 76 of guide member 60.

The right-hand end of sleeve member 68 includes a closure member 78. In the FIG. 2 embodiment, closure member 78 is cupped and has a rim 79 received by sleeve member 68, a flat base 80 engageable with seat 54, and an annular lip 82 embracing the shank 84 of valve 56.

A coil 86 surrounds sleeve member 68. When energized, such as through a switch 88, coil 86 moves sleeve member 68 right-wardly against the bias of spring 72 to engage closure member 78 against seat 54 thereby interrupting fuel flow through outlet 52 and discharge port 32.

Switch 88 may be closed during deceleration to interrupt fuel flow and thus reduce fuel consumption and, in some instances, the emission of undesirable exhaust gas constituents from the engine. Further, it will be appreciated that switch 88 also could be closed momentarily when the engine is stopped to interrupt fuel flow and thus inhibit dieseling or afterrunning of the engine. In addition, it will be understood that spring 72 could be deleted, that another spring could be added to bias closure sleeve 68 into engagement with seat 54, and that coil 86 could be energized to move closure sleeve 68 away from seat 54 whenever idle fuel flow is desired.

FIG. 3 illustrates a modified sleeve member 68' having a separate plug 90 which forms a shoulder 74' to engage guide member end 76 and which includes a closure member 78' in the form of a thickened 0-ring adapted to engage seat 54.

FIG. 4 illustrates another modification in which a body member 38'' and a sleeve member 68'' are cooperatively beveled to form a seat 54'' engageable by a closure portion 78'' formed directly on sleeve member 68''.

In each of these embodiments, it will be noted that the tapered idle mixture adjusting valve 56 and the associated idle fuel discharge port 32 are separate from the closure and its seat. Thus the adjusting valve does not engage the discharge port, and wear of these two components — with a concomitant change in idle mixture calibration — is precluded.

It also will be noted that shut-off valve assembly 36 is a compact unit carrying the idle mixture adjusting valve as well as the closure and seat. This construction permits servicing of the shut-off and adjusting mechanisms as a unit. It will be appreciated, however, that the tapered metering portion 58 of valve 56 may cooperate with a separate orifice formed in outlet 52 rather than directly with discharge port 32 while maintaining all the benefits of this invention.

The embodiments of the invention in which an exclusive property or privilege is claimed are defined as follows:

1. A fuel shut-off valve assembly for use in an internal combustion engine carburetor having a fuel passage, said fuel shut-off valve assembly comprising means defining a discharge port in said fuel passage and an annular seat in said fuel passage surrounding said port, a valve disposed in said fuel passage and having a tapered metering portion disposed in said port for controlling fuel flow therethrough, a closure sleeve mounted about and slidable relative to said valve and including a portion engageable with said seat, and operating means for sliding said sleeve into engagement with said seat to thereby reduce fuel flow through said passage.

2. A fuel shut-off valve assembly for use with an internal combustion engine carburetor having an induction passage for air flow to the engine, a throttle disposed in said induction passage for controlling flow therethrough, and a fuel passage having a discharge port opening into said induction passage downstream of said throttle, said fuel shut-off valve assembly comprising a hollow body adapted to form a portion of said passage and defining a seat in said passage adapted to surround said port, a guide member disposed within said body, a valve having a threaded portion supported within said guide member and a tapered metering portion adapted for disposition within said port, said valve being adjustable within said guide member to locate said tapered metering portion at a desired position within said port and thereby control fuel flow through said port, a sleeve member mounted about and slidable relative to said guide member within said body and having a closure portion engageable with said seat, said sleeve member being reciprocable between a first position wherein said closure portion is disengaged from said seat to permit fuel flow through said passage and a said second position wherein said closure portion is engaged with said seat to reduce fuel flow through said passage, spring means biasing said sleeve member to one of said positions, and a coil associated with said sleeve member and energizable for moving said sleeve member from said one position to the other of said positions against the bias of said spring means.

* * * * *